US011084059B2

(12) United States Patent
Kuribayashi et al.

(10) Patent No.: US 11,084,059 B2
(45) Date of Patent: Aug. 10, 2021

(54) METHOD FOR PRODUCING RARE-EARTH MAGNET

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 193 days.

(21) Appl. No.: 15/570,233

(22) PCT Filed: Apr. 18, 2016

(86) PCT No.: PCT/JP2016/062215
§ 371 (c)(1),
(2) Date: Oct. 27, 2017

(87) PCT Pub. No.: WO2016/175069
PCT Pub. Date: Nov. 3, 2016

(65) Prior Publication Data

US 2018/0133751 A1 May 17, 2018

(30) Foreign Application Priority Data

Apr. 28, 2015 (JP) ..... JP2015-092061

(51) Int. Cl.
*B05D 1/04* (2006.01)
*B05D 1/06* (2006.01)
(Continued)

(52) U.S. Cl.
CPC ..... *B05D 1/06* (2013.01); *B05B 5/053* (2013.01); *B05B 5/082* (2013.01); *B22F 3/24* (2013.01);
(Continued)

(58) Field of Classification Search
CPC ..... H01F 41/0293; H01F 7/02; H01F 1/086; H01F 4/0293; H01F 1/057; H01F 1/053;
(Continued)

(56) References Cited

U.S. PATENT DOCUMENTS 2,245,089 A * 6/1941 Hargrave ..... B23K 37/0435 269/249
2,599,010 A * 6/1952 Kalman ..... B05C 13/00 269/55
(Continued)

FOREIGN PATENT DOCUMENTS

CA 1764990 A 4/2006
CN 103996525 * 2/2014
(Continued)

OTHER PUBLICATIONS

International Search Report for PCT/JP2016/062215 (PCT/ISA/210) dated Jul. 19, 2016.
(Continued)

*Primary Examiner* — Tabassom Tadayyon Eslami
(74) *Attorney, Agent, or Firm* — Birch, Stewart, Kolasch & Birch, LLP

(57) ABSTRACT

A sintered magnet body is held in a grounded jig exhibiting excellent electrical conductivity, a rare-earth-compound powder is charged and sprayed on the sintered magnet body to electrostatically coat the sintered magnet body with the powder, and thus apply the powder to the sintered magnet body. The sintered magnet body having the powder applied thereto is heat treated to produce a rare-earth magnet. As a result, the rare-earth-compound powder can be uniformly applied to the surface of the sintered magnet body, and the application operating can be performed extremely efficiently.

8 Claims, 2 Drawing Sheets

(51) Int. Cl.

| | |
|---|---|
| ***C22C 33/02*** | (2006.01) |
| ***C21D 6/00*** | (2006.01) |
| ***B22F 3/24*** | (2006.01) |
| ***H01F 1/057*** | (2006.01) |
| ***B05B 5/08*** | (2006.01) |
| ***B05B 5/053*** | (2006.01) |
| ***H01F 1/08*** | (2006.01) |
| ***H01F 41/02*** | (2006.01) |
| *C22C 38/00* | (2006.01) |
| *B05B 5/035* | (2006.01) |
| *B05B 13/02* | (2006.01) |

(52) U.S. Cl.
CPC ..... *C21D 6/00* (2013.01); *C22C 33/02* (2013.01); *H01F 1/057* (2013.01); *H01F 1/0577* (2013.01); *H01F 1/086* (2013.01); *H01F 41/0293* (2013.01); *B05B 5/035* (2013.01); *B05B 13/0221* (2013.01); *C22C 38/00* (2013.01)

(58) Field of Classification Search
CPC ..... H01F 1/0536; B05D 1/10; B05D 1/12; B05D 1/06; B05D 1/04; B05D 1/007; C23C 14/50; C23C 14/505; H01L 21/688; H01L 21/6831; H01L 21/6833; H01L 21/6838; H01L 21/687; H01L 21/68778; H01L 21/68707; H01L 21/68721; H01L 21/68728; H01L 21/68757; H01J 37/32715; B05C 13/00; B05B 5/053; B05B 5/00; B05B 5/0255; B05B 5/032; B05B 5/1683; H01B 13/0033
USPC ..... 427/475, 427, 483, 458, 460, 533, 535, 427/562, 569, 906, 434.6, 472; 428/822.5, 822.3, 649 RE; 279/128, 89, 279/152, 8, 87; 118/730, 729
See application file for complete search history.

(56) References Cited

U.S. PATENT DOCUMENTS

| | | | | |
|---|---|---|---|---|
| 7,559,996 | B2 | 7/2009 | Miyata et al. | |
| 8,377,233 | B2 | 2/2013 | Nakamura et al. | |
| 2002/0046458 | A1 | 4/2002 | Niimi et al. | |
| 2003/0148028 | A1 | 8/2003 | Kimura et al. | |
| 2006/0005930 | A1* | 1/2006 | Ikeda | H01J 37/32431 156/345.51 |
| 2006/0022175 | A1* | 2/2006 | Komuro | H01F 1/0572 252/500 |
| 2006/0034032 | A1* | 2/2006 | White | C23C 16/4586 361/234 |
| 2006/0278517 | A1* | 12/2006 | Machida | H01F 41/0253 204/192.1 |
| 2008/0213496 | A1* | 9/2008 | Sun | C23C 4/18 427/453 |
| 2008/0245442 | A1* | 10/2008 | Nakamura | B22F 9/023 148/101 |
| 2012/0139388 | A1* | 6/2012 | Iwasaki | B22F 3/24 310/254.1 |
| 2014/0352847 | A1* | 12/2014 | Yu | B22F 3/26 148/104 |
| 2015/0086710 | A1 | 3/2015 | Takagi | |

FOREIGN PATENT DOCUMENTS

| | | | |
|---|---|---|---|
| JP | 55-108723 | A | 8/1980 |
| JP | 11-238620 | A | 8/1999 |
| JP | 2002-126612 | A | 5/2002 |
| JP | 2003-230852 | A | 8/2003 |
| JP | 2004-079782 | A | 3/2004 |
| JP | 2007-053351 | A | 3/2007 |
| JP | 2010-242136 | A | 10/2010 |
| JP | 2015-065218 | A | 4/2015 |
| JP | 2015-73941 | A | 4/2015 |
| WO | WO 2006/043348 | A1 | 4/2006 |

OTHER PUBLICATIONS

Written Opinion of the International Searching Authority for PCT/JP2016/062215 (PCT/ISA/237) dated Jul. 19, 2016.
Japanese Office Action for corresponding Japanese Application No. 2015-092061, dated Feb. 13, 2018.
Extended European Search Report, dated Nov. 20, 2018, for European Application No. 16786346.3.
Chinese Office Action and Search Report dated May 7, 2019, for corresponding Chinese Application No. 201680023920.2.

* cited by examiner

METHOD FOR PRODUCING RARE-EARTH MAGNET

TECHNICAL FIELD

This invention relates to a method for producing rare earth magnet by coating a sintered magnet body with a rare earth compound-containing powder and heat treating for causing the rare earth element to be absorbed in the magnet body, wherein the rare earth compound powder is uniformly and efficiently coated and rare earth magnet having excellent magnetic properties is efficiently produced.

BACKGROUND ART

Rare earth permanent magnets including Nd—Fe—B base magnets find an ever spreading application owing to their excellent magnetic properties. Methods known in the art for further improving the coercivity of these rare earth magnets include a method for producing a rare earth permanent magnet by coating the surface of a sintered magnet body with a rare earth compound powder, and heat treating the coated body for causing the rare earth element to be absorbed and diffused in the sintered magnet body (Patent Document 1: JP-A 2007-053351, Patent Document 2: WO 2006/043348). This method is successful in increasing coercivity while suppressing any decline of remanence.

This method, however, leaves room for further improvement. That is, in the prior art, a sintered magnet body is generally coated with the rare earth compound by immersing the magnet body in a slurry of a rare earth compound-containing powder dispersed in water or organic solvent, or spraying the slurry to the magnet body, and then drying. Since the immersion and spray methods are difficult to control the coating weight of the powder, the methods may fail in sufficient absorption of the rare earth element, or inversely, a more than necessary amount of the powder may be coated, leading to a wasteful consumption of noble rare earth element. In addition, since the thickness of the powder coating is liable to vary and the density of the coating is not so high, an excessive coating weight is necessary in order to boost the coercivity increase to a saturation level. Since the adhesion of the powder coating is weak, the process from the coating step to the completion of heat treatment step is not necessarily efficient.

It is thus desired to develop a coating method capable of uniformly and efficiently coating a rare earth compound powder, controlling the coating weight, and forming a dense powder coating in tight bond.

PRIOR ART DOCUMENTS

Patent Documents

Patent Document 1: JP-A 2007-053351
Patent Document 2: WO 2006/043348

SUMMARY OF THE INVENTION

Problems to be Solved by the Invention

An object of the invention, which is made under the above circumstances, is to provide a method for producing rare earth permanent magnet comprising the steps of coating a sintered magnet body of $R^1$—Fe—B composition (wherein $R^1$ is one or more elements selected from Y, Sc and rare earth elements) on its surface with a powder containing one or more compounds selected from an oxide, fluoride, oxyfluoride, hydroxide and hydride of $R^2$ (wherein $R^2$ is one or more elements selected from Y, Sc and rare earth elements), and heat treating the coated magnet body, the method being capable of uniformly and efficiently coating the powder, controlling the coating weight, forming a dense powder coating in tight bond, and producing rare earth magnet with better magnetic properties efficiently.

Means for Solving the Problems

Making extensive investigations to attain the above object, the inventors have found that in the method for producing a rare earth permanent magnet by the steps of coating a sintered magnet body of $R^1$—Fe—B composition (wherein $R^1$ is one or more elements selected from Y, Sc and rare earth elements) on its surface with a powder containing one or more compounds selected from an oxide, fluoride, oxyfluoride, hydroxide and hydride of $R^2$ (wherein $R^2$ is one or more elements selected from Y, Sc and rare earth elements), and heat treating the coated magnet body, if the powder is electrically charged and sprayed to the grounded magnet body to electrostatically deposit the powder on the magnet body, then the magnet body is uniformly and efficiently coated with the powder, the coating weight is controlled, a dense powder coating is formed in tight bond, and rare earth magnet with better magnetic properties is efficiently produced. The invention is predicated on this finding.

Accordingly, the invention provides:

[1] A method for producing rare earth permanent magnet comprising the steps of coating a sintered magnet body of $R^1$—Fe—B composition (wherein $R^1$ is one or more elements selected from Y, Sc and rare earth elements) with a powder containing one or more compounds selected from an oxide, fluoride, oxyfluoride, hydroxide and hydride of $R^2$ (wherein $R^2$ is one or more elements selected from Y, Sc and rare earth elements), and heat treating the coated magnet body for causing $R^2$ to be absorbed in the magnet body, wherein the step of coating the magnet body with the powder includes the steps of holding the sintered magnet body by a grounded electroconductive jig, and spraying the powder as electrically charged to the sintered magnet body to electrostatically deposit the powder on the magnet body.

Making further investigations, the inventors have found that charging by a corona discharge is preferred for the charging of the powder; that coercivity is further improved by applying a liquid to the powder coating to once wet the coating, drying the wet coating, and thereafter performing the heat treatment; a preferred form of jig, a preferred voltage to be applied when the powder is electrically charged using a corona gun, and a preferred coating weight of the powder.

Accordingly, the invention provides the following methods [2] to [8] as preferred embodiments.

[2] The rare earth magnet producing method of [1] wherein the powder is electrically charged by a corona discharge before the electrostatic deposition is performed.

[3] The rare earth magnet producing method of [2] wherein using a corona gun, the powder is corona charged and sprayed to perform the electrostatic deposition, a voltage of at least −60 kV is applied to the tip of the corona gun, and the coating weight of the powder on the magnet body is at least 850 mg/dm$^2$.

[4] The rare earth magnet producing method of any one of [1] to [3] wherein a liquid is sprayed to the surface of the sintered magnet body prior to the electrostatic deposition, the electrostatic deposition is performed in the presence of the liquid on the sintered magnet body surface to form a coating of the powder, and the coating is dried prior to the heat treatment.

[5] The rare earth magnet producing method of any one of [1] to [3] wherein after the electrostatic deposition, a liquid is sprayed to the coating of the powder deposited on the surface of the sintered magnet body to wet the coating, and the coating is dried prior to the heat treatment.

[6] The rare earth magnet producing method of [4] or [5] wherein the liquid is sprayed in an amount of at least 1 $ml/dm^2$.

[7] The rare earth magnet producing method of any one of [4] to [6] wherein the liquid is pure water.

[8] The rare earth magnet producing method of any one of [1] to [7] wherein the jig is made of a material selected from copper, copper alloys, aluminum, iron, iron alloys, and titanium, and includes holding portions having a pointed end such that the magnet body is held by clamping the magnet body between the holding portions, and portions other than the contacts of the holding portions with the magnet body and electric contacts for grounding which are coated with a plastisol.

Advantageous Effects of the Invention

According to the invention, a rare earth compound powder can be coated without a need for cumbersome works or steps such as preparation of a slurry by dispersing the powder in a solvent. A dense powder coating in tight bond can be formed while the coating weight of the powder is easily and properly controlled by adjusting the charging potential and spraying amount of the powder. Additionally, a non-deposited fraction of the powder can be easily and efficiently recovered as compared with the slurry coating.

According to the invention, the sintered magnet body is uniformly coated on its surface with the rare earth compound powder, and the coating step is carried out quite efficiently. Rare earth magnet having improved magnetic properties including a fully increased coercivity can be efficiently produced.

BRIEF DESCRIPTION OF THE DIAGRAMS

FIG. 1 schematically illustrates one exemplary jig used in the producing method of the invention, (A) being a schematic plan view and (B) being a partial cross-sectional view taken along line B-B in FIG. 1(A).

EMBODIMENT FOR CARRYING OUT THE INVENTION

Figure 1A:
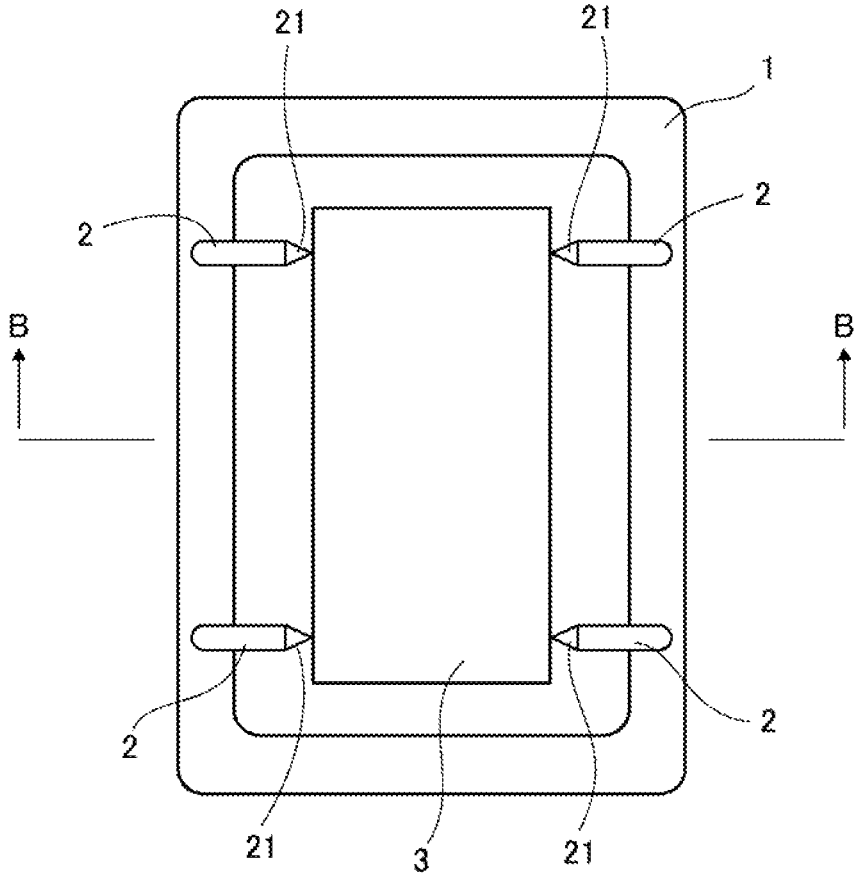

As described above, the method for producing rare earth magnet according to the invention includes the steps of coating a sintered magnet body of $R^1$—Fe—B composition (wherein $R^1$ is one or more elements selected from Y, Sc and rare earth elements) with a powder containing an oxide, fluoride, oxyfluoride, hydroxide or hydride of $R^2$ (wherein $R^2$ is one or more elements selected from Y, Sc and rare earth elements), and heat treating the coated magnet body for causing $R^2$ to be absorbed in the magnet body.

The $R^1$—Fe—B sintered magnet body used herein may be one obtained by any well-known method. For example, a sintered magnet body may be obtained by coarsely milling a mother alloy containing $R^1$, Fe and B, finely pulverizing, compacting and sintering according to the standard method. It is noted that $R^1$ is one or more elements selected from Y, Sc and rare earth elements, specifically Y, Sc, La, Ce, Pr, Nd, Sm, Eu, Gd, Tb, Dy, Ho, Er, Yb, and Lu.

According to the invention, the $R^1$—Fe—B sintered magnet body is shaped to a predetermined shape as by grinding, if necessary, coated on its surface with a powder containing one or more compounds selected from an oxide, fluoride, oxyfluoride, hydroxide and hydride of $R^2$, and heat treated for causing absorption and diffusion (grain boundary diffusion) of $R^2$ into the magnet body, thereby obtaining the desired rare earth magnet.

It is noted that $R^2$ is one or more elements selected from Y, Sc and rare earth elements, specifically Y, Sc, La, Ce, Pr, Nd, Sm, Eu, Gd, Tb, Dy, Ho, Er, Yb, and Lu, like $R^1$ mentioned above. It is preferred, though not limited, that $R^2$ contain at least 10 at %, more preferably at least 20 at %, and even more preferably at least 40 at % in total of Dy and/or Tb. It is more preferred in view of the object of the invention that $R^2$ contain at least 10 at % of Dy and/or Tb and the total concentration of Nd and Pr in $R^2$ be lower than the total concentration of Nd and Pr in $R^1$.

While the particle size of the powder containing one or more compounds selected from an oxide, fluoride, oxyfluoride, hydroxide and hydride of $R^2$ is not particularly limited, a particle size commonly employed as a rare earth compound powder used for absorptive diffusion (grain boundary diffusion) may be selected, and specifically, an average particle size of preferably up to 100 μm, more preferably up to 10 μm. The lower limit of particle size is preferably at least 1 nm, though not limited. The average particle size may be determined as a weight average value $D_{50}$ (i.e., particle size corresponding to a cumulative weight of 50% or median diameter) using a particle size distribution measuring system based on the laser diffraction method or the like.

According to the invention, the sintered magnet body is coated with the powder by holding the magnet body in place, and spraying the powder as electrically charged to the grounded magnet body to electrostatically deposit the powder on the magnet body.

The mode of charging the powder with electricity may be either a triboelectric mode of charging the powder by friction or a corona charging mode of charging the powder by corona discharge. The corona charging mode is preferably used because the powder can be charged independent of its identity so that optimum coating conditions may be easily determined as compared with the triboelectric mode. In either mode, the powder may be electrically charged and sprayed using a commercial electrostatic deposition gun, for example, automatic powder coating gun X-3a from Asahi Sunac Corp. for the corona charging mode and automatic powder coating gun T-3a from Asahi Sunac Corp. for the triboelectric mode.

When the powder is charged and sprayed using a corana gun (electrostatic powder coating gun of the corona discharge mode), the coating weight of the powder is relatively easily adjusted by adjusting the voltage applied to the tip of the corona gun and the feed rate of the powder. In the practice of the invention, it is preferred, though not limited, that the coating weight of the powder be adjusted to at least 850 $mg/dm^2$ by setting the voltage applied to the tip of the corona gun to at least −60 kV (equal to or more negative than −60 kV), especially −70 kV to −80 kV, and feeding a predetermined amount of the powder at a constant rate by means of a metering feeder or the like.

On the other hand, the sintered magnet body is held by a highly electroconductive jig and subjected to electrostatic deposition in the state grounded by the jig. Preferred examples of the highly conductive material of which the jig is made include copper, copper alloys, aluminum, iron, iron alloys, and titanium, but are not limited thereto. The shape of the jig is not particularly limited, and any desired shape may be selected depending on the shape and size of the sintered magnet body. For example, the jig is preferably constructed to include holding portions having a pointed end such that the magnet body is held by clamping the magnet body between the holding portions.

Figure 1B:
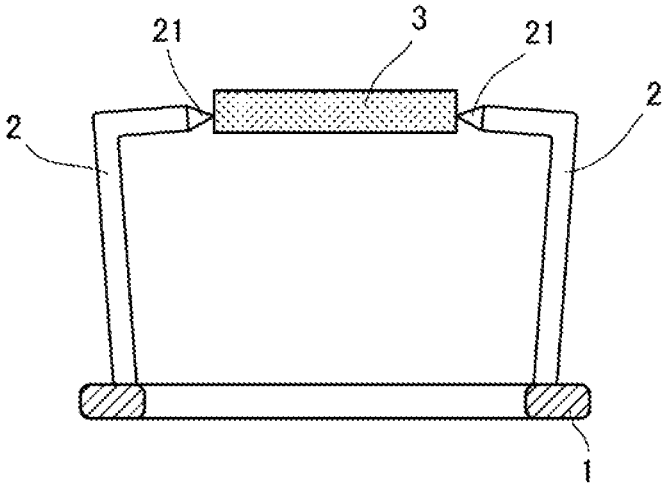

The jig is embodied by an exemplary jig illustrated in FIG. 1. Illustrated in FIG. 1 are a base 1 of rectangular frame shape and four holder arms 2 anchored upright to the base 1. A distal portion of each holder arm 2 is bent like hook and has a holding portion 21 of pointed cone shape at its tip. Two pairs of holder arms 2 are anchored upright so that the holding portions of each pair are opposed to each other. The sintered magnet body 3 is held by clamping it between the holding portions 21 of the holder arms 2. While the jig is made of highly conductive material, those portions of the jig other than the contacts of the holding portions 21 with the magnet body 3 and electric contacts for grounding (not shown) are preferably coated with a plastisol so as to avoid deposition of the powder.

The sintered magnet body having a powder coating formed by coating the powder in this way is subsequently heat treated to cause absorptive diffusion of the rare earth element into the magnet body. The powder deposited to the magnet body surface by electrostatic deposition as such tends to scatter off. If powder particles scatter off until the heat treatment, even in a small amount, then the coercivity increasing effect and coating uniformity may be slightly degraded. It is thus preferred, though not limited, that a liquid be applied to the powder coating to once wet the coating and the wet coating be dried, before the heat treatment is carried out. Examples of the liquid to be applied include alcohols such as ethyl alcohol and pure water. Inter alia, pure water is preferred from the aspect of cost.

Application of the liquid may be implemented by spraying. In one procedure, a liquid such as pure water is sprayed to the surface of the sintered magnet body prior to the electrostatic deposition and the sintered magnet body in the presence of pure water or liquid on its surface is subjected to the electrostatic deposition. In another procedure, after the electrostatic deposition is performed, pure water or liquid is sprayed to the powder coating. Although a sufficient effect is available from liquid application before or after the electrostatic deposition, a better effect is available from spraying of pure water or liquid to the surface of the sintered magnet body prior to the electrostatic deposition. It is noted that although the amount of pure water or liquid applied is determined appropriate depending on the size and shape of the sintered magnet body, the particle size of the powder, and the thickness of the coating, and not particularly limited, the amount is preferably at least 1 $ml/dm^2$, especially 2 to 3 $ml/dm^2$.

The powder coating by electrostatic deposition may be modified for mass production by conveying the sintered magnet body held by the jig along a hanger conveying rail, for example, and continuously conducting electrostatic deposition on a plurality of sintered magnet bodies. A production setup as shown in FIG. 2 is exemplary.

Figure 2:
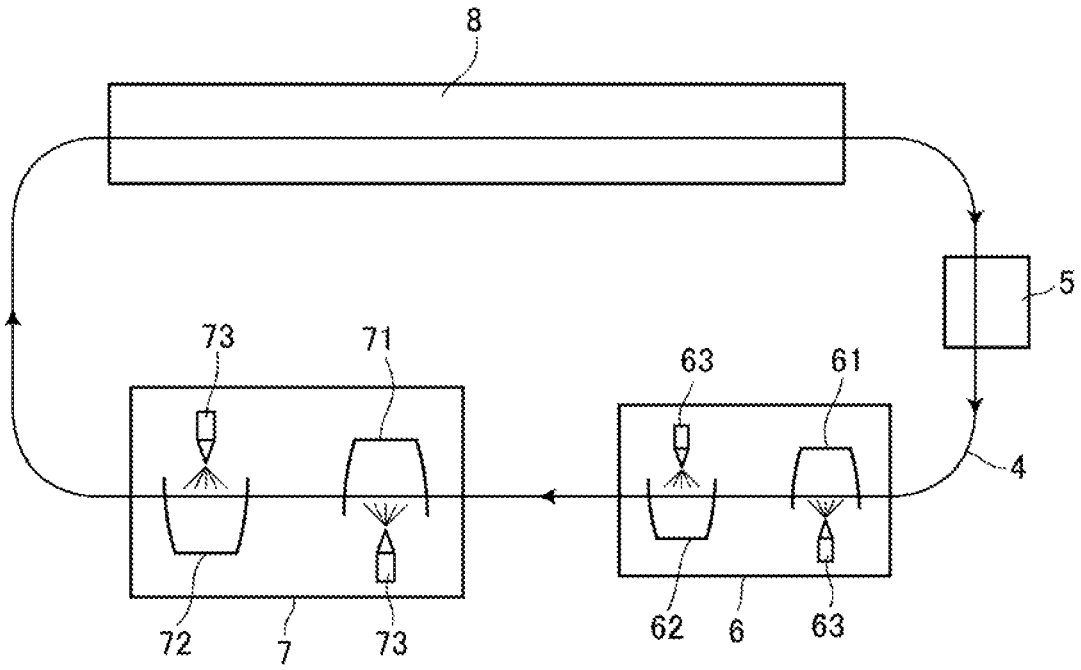
FIG. 2 is a schematic view showing one exemplary electrostatic deposition system for carrying out the powder coating step in the inventive producing method.

The setup illustrated in FIG. 2 includes a hanger conveying rail 4 for conveying the sintered magnet body mounted on the jig at a predetermined speed, a load/unload zone 5 where the sintered magnet body is mounted on the jig, a pretreatment zone 6, an electrostatic deposition zone 7, and a drying zone 8, wherein the sintered magnet body is conveyed along the rail and past the zones 6, 7 and 8 sequentially until a coating of the powder is formed. The sintered magnet body having the powder coating formed thereon is recovered in the load/unload zone 5.

The pretreatment zone 6 includes a front surface treatment booth 61 and a back surface treatment booth 62 where pure water is sprayed to the front and back surfaces of the sintered magnet body by water spray guns 63. The electrostatic deposition zone 7 includes a front surface coating booth 71 and a back surface coating booth 72 where the powder is charged and sprayed to the sintered magnet body (grounded via the jig) by electrostatic coating guns 73 for electrostatically depositing the powder on the front and back surfaces of the magnet body. Further in the drying zone 8, drying treatment is effected at a temperature of about 50 to 70° C. for 5 to 10 minutes.

The sintered magnet body coated with a coating of the rare earth compound powder in this way is heat treated to cause absorptive diffusion of the rare earth element $R^2$ into the magnet body whereby a rare earth permanent magnet is produced.

Notably, the heat treatment to cause absorptive diffusion of the rare earth element $R^2$ may be performed by a well-known method. After the heat treatment, any well-known post-treatments including aging treatment under suitable conditions and machining to a practical shape may be performed, if necessary.

EXAMPLE

Embodiments of the invention are described by referring to Example although the invention is not limited thereto.

Example 1

A thin plate of alloy was prepared by a so-called strip casting technique, specifically by weighing amounts of Nd, Al, Fe and Cu metals having a purity of at least 99 wt %, Si having a purity of 99.99 wt %, and ferroboron, high-frequency heating in argon atmosphere for melting, and casting the alloy melt on a copper single roll in argon atmosphere. The resulting alloy consisted of 14.5 at % Nd, 0.2 at % Cu, 6.2 at % B, 1.0 at % Al, 1.0 at % Si, and the balance of Fe. The alloy was exposed to 0.11 MPa of hydrogen at room temperature for hydriding, and then heated at 500° C. for partial dehydriding while evacuating to vacuum. It is cooled and sieved, obtaining a coarse powder having a size of up to 50 mesh.

On a jet mill using high-pressure nitrogen gas, the coarse powder was finely pulverized to a weight median particle size of 5 μm. The resulting fine powder was compacted in a nitrogen atmosphere under a pressure of about 1 $ton/cm^2$ while being oriented in a magnetic field of 15 kOe. The compact was then placed in a sintering furnace in argon atmosphere where it was sintered at 1,060° C. for 2 hours, obtaining a magnet block. Using a diamond cutter, the magnet block was machined on all the surfaces, cleaned with alkaline solution, pure water, nitric acid and pure water in sequence, and dried, obtaining a block-shaped magnet body of 40 mm×20 mm×5 mm (in magnetic anisotropy direction).

The setup was equipped with a series of jigs as shown in FIG. 1 and the sintered magnet bodies were mounted on the jigs and grounded. Using an electrostatic powder coating system XR4-100PS from Asahi Sunac Corp., dysprosium fluoride powder was corona discharged and sprayed in a coating weight of at least 850 mg/dm$^2$ to form a coating of dysprosium fluoride powder on the surface of sintered magnet bodies. Notably, the voltage setting at the tip of the corona gun was 75 kV×80 μA.

Figure 3:
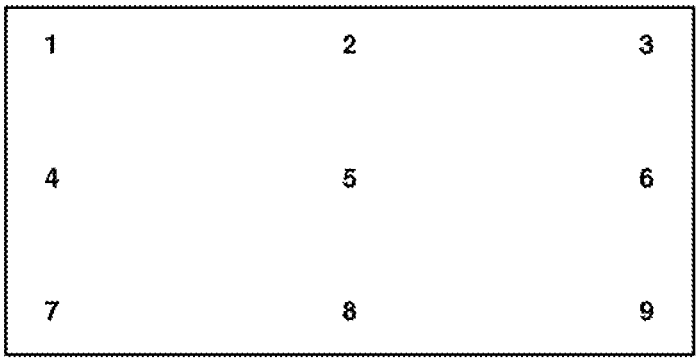
FIG. 3 illustrates positions where coercivity is measured in Examples.

The magnet bodies having a coating of dysprosium fluoride powder formed thereon were heat treated at 900° C. for 5 hours in Ar atmosphere for absorptive treatment, age treated at 500° C. for 1 hour, and quenched, obtaining rare earth magnet samples. From each of three magnet samples, magnet pieces of 2 mm×2 mm×5 mm were cut out at nine positions corresponding to the center and sides of the magnet sample shown in FIG. 3, which were measured for coercivity. For each magnet sample, an average of coercivity values at 9 positions is reported in Table 1.

Example 2

The sintered magnet body obtained as in Example 1 was held by the jig. Pure water was sprayed to apply 3 ml/dm$^2$ of pure water to the surface of the sintered magnet body to wet the magnet body surface. As in Example 1, the sintered magnet body was coated with dysprosium fluoride powder to form a coating of dysprosium fluoride powder. The coated magnet body was dried at 60° C. for 5 minutes and then heat treated as in Example 1, obtaining rare earth magnet. Similarly coercivity was measured, with the results shown in Table 1.

Example 3

The sintered magnet body obtained as in Example 1 was coated with dysprosium fluoride powder as in Example 1 to form a coating of dysprosium fluoride powder. Pure water was sprayed to the sintered magnet body to apply 3 ml/dm$^2$ of pure water to wet the coating. The coated magnet body was dried at 60° C. for 5 minutes and then heat treated as in Example 1, obtaining rare earth magnet. Similarly coercivity was measured, with the results shown in Table 1.

TABLE 1

| Pure water spray | | Sample 1 | Sample 2 | Sample 3 |
|---|---|---|---|---|
| Example 1 | untreated | 7.9 | 8.1 | 8.1 |
| Example 2 | prior to powder coating | 10.8 | 11.0 | 10.9 |
| Example 3 | after powder coating | 9.4 | 9.3 | 9.5 |

unit: kOe

REFERENCE SIGNS LIST

1 base
2 holder arm
21 holding portion
3 sintered magnet body
4 hanger conveying rail
5 load/unload zone
6 pretreatment zone
61 front surface treatment booth
62 back surface treatment booth
63 pure water spray gun
7 electrostatic deposition zone
71 front surface coating booth
72 back surface coating booth
73 electrostatic deposition gun
8 drying zone

The invention claimed is:

1. A method for producing rare earth permanent magnet comprising the steps of:

holding a sintered magnet body of $R^1$—Fe—B composition, where $R^1$ is one or more elements selected from a group consisting of Y, Sc, La, Ce, Pr, Nd, Sm, Eu, Gd, Tb, Dy, Ho, Er, Yb, and Lu, by a grounded electroconductive jig;

electrically charging a dry powder to obtain an electrically charged dry powder, the powder containing one or more compounds selected from an oxide, fluoride, oxyfluoride, hydroxide and hydride of $R^2$, where $R^2$ is one or more elements selected from a group consisting of Y, Sc, La, Ce, Pr, Nd, Sm, Eu, Gd, Tb, Dy, Ho, Er, Yb, and Lu;

applying the electrically charged dry powder to a surface of the sintered magnet body which is electrically grounded, so that the surface of the sintered magnet body is covered with the dry powder by electrostatically depositing the dry powder directly on the surface of the magnet body to directly coat the sintered magnet body with the dry powder; and then heat treating the coated magnet body for causing $R^2$ to be absorbed in the magnet body.

2. The rare earth magnet producing method of claim 1 wherein after the electrostatic deposition, a liquid is sprayed to the coating of the dry powder deposited on the surface of the sintered magnet body to wet the coating, and the coating is dried prior to the heat treatment.

3. The rare earth magnet producing method of claim 1 wherein the jig is made of a material selected from a group consisting of copper, copper alloys, aluminum, iron, iron alloys, and titanium, and includes holding portions having a pointed end such that the magnet body is held by clamping the magnet body between the holding portions, and portions of the jig other than the contacts of the holding portions with the magnet body and electric contacts for grounding are coated with a plastisol.

4. The rare earth magnet producing method of claim 1 wherein the dry powder is electrically charged by a corona discharge before the electrostatic deposition is performed.

5. The rare earth magnet producing method of claim 4 wherein using a corona gun, the powder is corona charged and applied to perform the electrostatic deposition, a voltage of at least −60 kV is applied to the tip of the corona gun, and the coating weight of the dry powder on the magnet body is at least 850 mg/dm$^2$.

6. The rare earth magnet producing method of any one of claims 1 to 5, wherein a liquid is sprayed to the surface of the sintered magnet body prior to the electrostatic deposition, the electrostatic deposition is performed in the presence of the liquid on the sintered magnet body surface to form a coating of the dry powder, and the coating is dried prior to the heat treatment.

7. The rare earth magnet producing method of claim 6 wherein the liquid is sprayed in an amount of at least 1 ml/dm$^2$.

8. The rare earth magnet producing method of claim 6 wherein the liquid is pure water.

* * * * *